United States Patent [19]

Rabelos

[11] 4,286,526

[45] Sep. 1, 1981

[54] COIN BANK

[75] Inventor: Nicholas A. Rabelos, Jonesboro, Ga.

[73] Assignee: Charles J. Simpson, Morrow, Ga.

[21] Appl. No.: 103,511

[22] Filed: Dec. 12, 1979

[51] Int. Cl.[3] ..... A45C 1/12

[52] U.S. Cl. ..... 109/73; 232/6; 109/24

[58] Field of Search ..... 109/73, 64, 66; 232/4 D, 4 R, 6; 292/86

[56] References Cited

U.S. PATENT DOCUMENTS

| | | | |
|---|---|---|---|
| 85,647 | 1/1869 | Dolan | 109/73 |
| 245,786 | 8/1881 | Centlivre | 292/254 |
| 462,658 | 11/1891 | Baier | 292/254 |
| 651,464 | 6/1900 | Lint | 292/254 |
| 1,378,682 | 5/1921 | Kirkpatrick | 232/6 |
| 2,429,494 | 10/1947 | Stephens | 232/4 |
| 2,718,726 | 9/1955 | Dunn | 232/4 |
| 3,115,762 | 12/1963 | Nemsky | 232/4 |
| 3,175,853 | 3/1965 | Gilbertson | 292/86 |

*Primary Examiner*—Reinaldo P. Machado
*Attorney, Agent, or Firm*—Harvey B. Jacobson

[57] ABSTRACT

A coin bank in the form of a hollow receptacle having a slidable bottom locked in closed position by a concealed locking device which can be rendered ineffective by inserting a release pin or the like into a very small passageway formed in the bottom of the receptacle to release the locking device with the passageway receiving the pin being concealed by a penetrable cushioning member. The bottom of the receptacle is provided with a plurality of directional arrows of distinguishable color pointing to a plurality of concealed passageways for receiving the releasing pin but only one of these passageways, is associated with the locking device. This passageway is known only to the owner of the bank or those having knowledge of the color code for a particular bank thereby more effectively preventing unauthorized removal of coins from the bank.

4 Claims, 7 Drawing Figures

Fig. 1
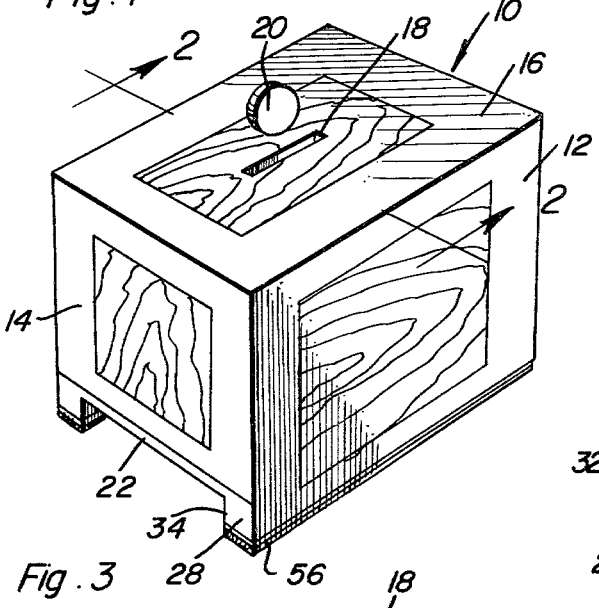
Fig. 2
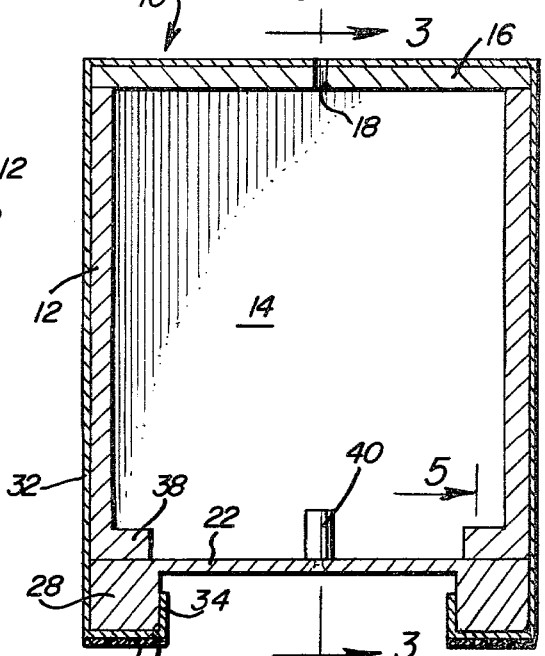
Fig. 3
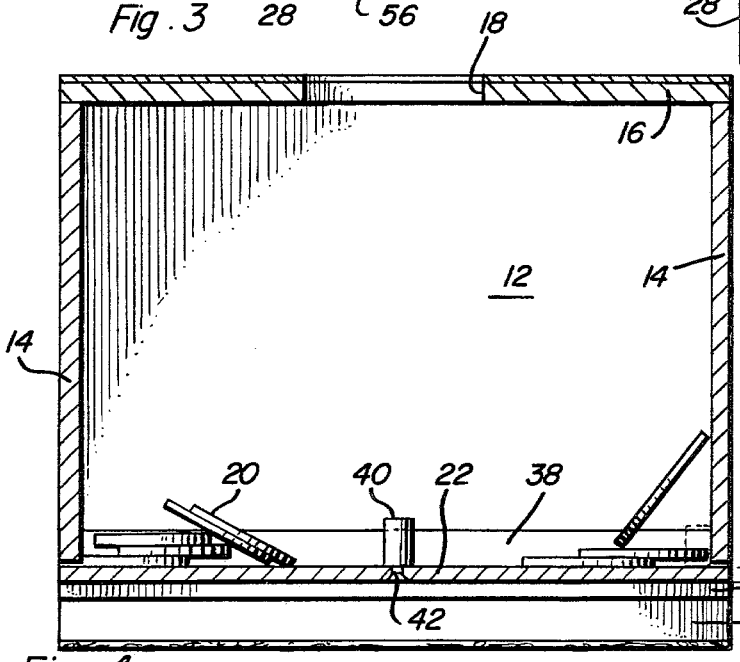
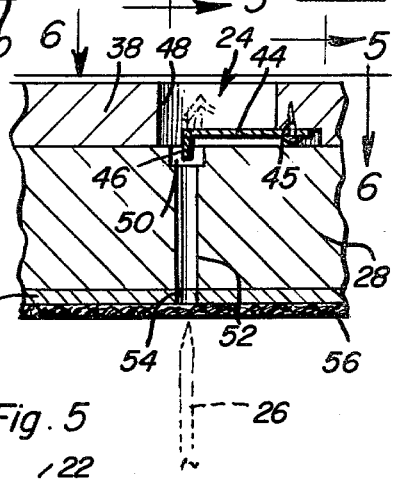
Fig. 5
Fig. 4
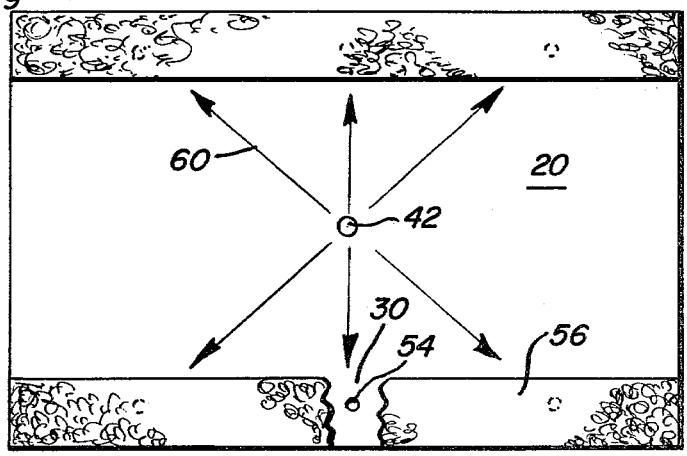
Fig. 6
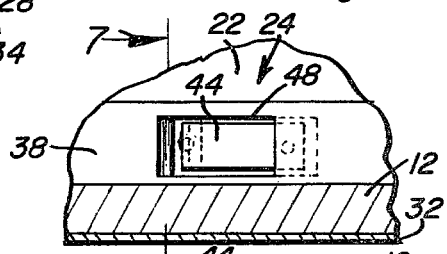
Fig. 7
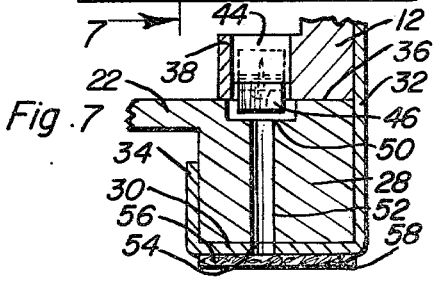

COIN BANK

BACKGROUND OF THE INVENTION

1. Field of the Invention

An object of the present invention is to provide a coin bank in the form of a hollow, parallelepiped receptacle having a coin receiving slot in the top wall thereof and a openable bottom provided with a concealed locking device in order to more effectively prevent unauthorized removal of coins from the coin bank.

2. Description of the Prior Art

Coin banks of various shapes, configurations and structural details have been provided for receiving coins and preventing unauthorized removal of the coins. In some instances, coin banks are made of glass or other breakable material so that the bank has to be destroyed in order to gain access to the coins. In other devices, key operated locks are provided to maintain the integrity of the bank. However, such key operated locks are usually relatively inexpensive and can be easily broken or tampered with to render them ineffective. Other coin banks have been provided which have concealed locking devices necessitating a special tool for gaining access to the interior of the bank which perform satisfactorily but if the special tool is lost, it may become necessary to destroy the bank in order to gain access to the interior thereof. The following U.S. patents are illustrative of the state of the art in this field of endeavor:

| | |
|---|---|
| 245,786 | 2,429,494 |
| 462,658 | 2,718,726 |
| 651,464 | 3,002,313 |
| 1,182,158 | 3,115,762 |
| 1,395,008 | |

SUMMARY OF THE INVENTION

An object of the present invention is to provide a coin bank in the form of a hollow, rectangular, parallelepiped receptacle or container having a coin slot in one wall thereof and an openable closure releasably retained in closed position by a concealed locking device openable by insertion of a conventional pin into a concealed passageway covered by material which can be easily penetrated by a pin.

Another object of the invention is to provide a coin bank in accordance with the preceding object in which the closure is in the form of a slidable bottom wall retained in closed position by a spring biased locking member having a terminal end portion engaged in the inner end of the concealed passageway so that insertion of the pin will force the terminal end of the locking device out of the passageway to enable sliding movement of the bottom wall to an open position.

A further object of the invention is to provide a coin bank in accordance with the preceding objects in which the slidable bottom wall is retained in position by guides forming an extension of the side walls to enhance the integrity of the receptacle and the bottom wall includes side members received in the longitudinal guides with both the guides and side members including a plurality of concealed passageways with a longitudinally extending cushioning material on the guides forming means for concealing the passageways.

Still another object of the invention in to provide a coin bank in which a plurality of concealed passageways is provided in each of the banks with only a single locking member associated with one of the concealed passageways and a color coded plurality of directional arrows are provided on the bottom of the bank so that a person having knowledge regarding the color code can locate the concealed passageway for inserting a conventional pin into the concealed passageway and releasing the locking device in order to move the bottom wall to an open position.

A still further object of the present invention is to provide a coin bank in accordance with the preceding objects which is quite simple in construction, effective for preventing unauthorized removal of coins but yet enabling a person having appropriate knowledge regarding the coin bank to easily remove the coins, attractive in appearance and capable of use over many years.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the coin bank of the present invention.

FIG. 2 is a transverse, sectional view taken substantially upon a plane passing along section line 2—2 on FIG. 1 illustrating structural details of the bank.

FIG. 3 is a longitudinal, vertical sectional view taken substantially upon a plane passing along section line 3—3 on FIG. 2 illustrating further structural details of the coin bank.

FIG. 4 is a bottom plan view of the coin bank with a portion of the cushioning material broken away illustrating one of the concealed passageways and also illustrating the color coded arrows on the bottom of the bank.

FIG. 5 is a detailed fragmental sectional view taken substantially upon a plane passing along section line 5—5 on FIG. 2 illustrating further structural details of the locking mechanism.

FIG. 6 is a plan view taken substantially upon a plane passing along reference line 6—6 on FIG. 5 illustrating further structural details of the locking device.

FIG. 7 is a detailed fragmental view taken substantially upon a plane passing along section line 7—7 on FIG. 6 illustrating further structural details of the locking device.

DESCRIPTION OF THE PREFERRED EMBODIMENT

Referring now specifically to the drawings, the coin bank of the present invention is generally designated by the numeral 10 and is in the from of a hollow, rectangular parallelepiped receptacle having generally parallel rectangular side walls 12 and square or rectangular end walls 14 which are parallel to each other and perpendicular to the side walls 12. The upper end of the side walls 12 and end walls 14 are interconnected by a top wall 16 having a centrally located coin slot 18 therein for insertion of coins 20. The bottom of the bank 10 is provided with a slidable bottom wall 22 which normally closes the bottom end of the bank to retain the coins 20 therein but which can be slid longitudinally to an open position when a concealed locking device generally designated by numeral 24 is actuated to a released position by insertion of a long, rigid pointed member such as a conventional pin 26 in a particular manner in relation to the coin bank as described hereinafter thus enabling access to the coins 20 when desired.

The bottom wall 22 includes a longitudinally extending and continuous depending side edge member 28 which is in the form of a runner that is received in a guide channel 30 formed on the outer metal layer 32 of the side wall and which is secured to the side wall 12 in any suitable manner such as by attractive brads, adhesive material or the like. The bottom edges of the member 32, which is substantially of inverted U-shaped configuration and includes a web which overlies the top wall 16 are inturned and terminate in an upwardly extending flange 34 thus forming the channel-shaped guides 30 to receive the runners 28 and securely lock the side walls of the bank to the bottom wall 22 to prevent them from being spread apart by pulling laterally on the lower ends thereof since the upturned flange 34 on the inner edge of the guide 30 interlocks with the runner 28 which is integral with the wall 22. This structure also enables longitudinal sliding movement of the bottom wall 22 which has its upper surface slidably engaging the downwardly facing bottom edge 36 of the side wall 12 and a guide member 38 attached thereto with which the locking device 24 is associated. This structure prevents upward or inward movement of the bottom wall 22 in relation to the side and end walls. To prevent complete removal of the bottom wall 22, a peg or stop member 40 is mounted centrally to the interior center of the bottom wall 22 so that it will engage the end walls to limit longitudinal sliding movement of the bottom wall as illustrated in FIG. 3. The peg 40 may be secured in place by a screw threaded fastener 42 extending through the bottom wall 22 or it may be attached in any suitable manner which may be concealed from view when observing the bottom of the bottom wall 22.

The locking device 24 is in the form of a leaf spring member 44 having one end secured to the under surface of the guide member 38 such as by use of a fastening device 45 and the other end is provided with a perpendicularly extending end 46. The guide member 38 includes an opening 48 to enable upward flexing movement of the leaf spring 44 so that the locking flange or end 46 can move vertically in relation to a socket or recess 50 formed in the upper portion of the bottom wall 22 and runner 28. A concealed passageway 52 extends from the bottom of the socket 50 to the bottom surface of the runner 28 and is aligned with a corresponding opening or passageway 54 in the guide 30 so that the pin 26 can be inserted into the socket 50 so that it will engage the free edge of the locking flange or end 46 and force it upwardly out of the socket 50 into alignment with the shear line between the upper surface of the wall 22 and the lower surface of the guide 38, thereby enabling the wall 22 to be moved longitudinally to an open position. When the bottom wall 22 is moved back to a closed position with the end edges in alignment with the end walls, the locking flange 46 will return to its locked position in the socket 50 due to the resilient nature of the leaf spring 44.

The opening 54 and passageway 52 are concealed by a cushioning member 56 such as a felt or similar material which is secured to the bottom surface of the guide 30 such as by use of an adhesive 58 or the like. This material completely conceals the passageways and openings which receives the pin 26 but is penetrable by the pin 26 which may be a conventional straight pin, safety pin or the like.

To provide additional security for the coin bank, when the device is constructed, three concealed passageways and openings 52 and 54 would be provided along each guide member 30 and runner 28 with corresponding sockets 50 being formed in the top surface of the wall but only one of the passageways would have a locking device 24 associated therewith. To provide the owner or other authorized person with an indication as to which of the passageways has the locking device associated therewith, the bottom wall 22 is provided with a plurality of directional arrows 60 radiating from the center thereof and extending toward the respective openings and passageways. These arrows are differently colored and the purchaser of the bank would be provided with information that a particularly colored arrow indicates the opening and passageway with which the locking device is associated.

The coin slot 18 may be provided with any suitable conventional structure to make it more difficult to remove coins back through the coin slot either by inverting the coin bank or shaking it or introducing some type of coin extracting tool through this slot. Such a structure may be in the form of plastic material provided with a very narrow slit therein which is forced open by insertion of the coin. The metallic side wall may be provided with any suitable decorative material either painted thereon or laminated thereto to enhance the attractive appearance of the coin bank. For example, the metal may be burnished, or anodized aluminum and small nails or brads having decorative heads may be positioned along the side edges thereof to simulate the appearance of a treasure chest or the like. This type of coin bank is especially effective for use by children or young people to initiate the habit of saving coins and also is quite effective when placed in public places by charitable organizations and the like with suitable soliciting messages placed on the side walls as desired.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A coin bank comprising a hollow, rectangular parallelepiped receptacle with perpendicularly arranged walls with at least one wall including a coin receiving slot therein, another wall of said receptacle being movable between a closed position and an open position, and a concealed locking device for the movable wall to releasably retain it in closed position to prevent unauthorized removal of coins from the coin bank, said locking device including a small concealed passageway communicating with the exterior of the receptacle enabling insertion of a long narrow tool for disabling the locking device to enable the movable wall to be moved to an open position, said movable wall being the bottom wall of the receptacle, means slidably supporting the bottom wall from the side walls of the receptacle, said locking device being mounted on the side wall of the receptacle and including a locking member movably received in a recess in the slidable bottom wall, said passageway communicating with the bottom of the recess to enable the locking member to be moved out of the recess in the slidable bottom wall to enable sliding movement of the bottom wall, said locking device including a leaf spring member fixedly secured to the side wall at one end and including a laterally extending flange forming said locking member at the other end for movement into and out of the recess in the bottom wall, each side wall including a metal member extending below the bottom wall and terminating in an inturned flange having an upturned flange at its inner edge to define a channel-shaped guide, said bottom wall including longitudinal runners received in the guides to guide the movement of the bottom wall and limit lateral distortion of the side walls, thereby strengthening and rigidifying the receptacle.

2. The structure as defined in claim 1 together with a cushioning material covering the bottom of the channel-shaped guide, said guide having a small aperture in the bottom thereof aligned with the passageway through the runner on the bottom wall with the cushioning material concealing the small opening.

3. The structure as defined in claim 2 wherein said bottom wall includes upwardly extending means on the inner surface thereof to limit longitudinal sliding movement thereof.

4. The structure as defined in claim 3 wherein said bottom wall and guide includes a plurality of openings and passage ways along each side thereof, and color coated arrows on the bottom wall to indicate to an authorized person into which opening an elongated pin-like instrument must be inserted to disable the locking device.

* * * * *